US010224612B1

(12) United States Patent
Wang et al.

(10) Patent No.: US 10,224,612 B1
(45) Date of Patent: Mar. 5, 2019

(54) MOBILE DEVICE

(71) Applicant: Quanta Computer Inc., Taoyuan (TW)

(72) Inventors: Chun-Yuan Wang, Taoyuan (TW); Yu-Chun Lu, Taoyuan (TW); Chi-Hsuan Lee, Taoyuan (TW)

(73) Assignee: QUANTA COMPUTER INC., Guishan Dist., Taoyuan (TW)

( * ) Notice: Subject to any disclaimer, the term of this patent is extended or adjusted under 35 U.S.C. 154(b) by 0 days.

(21) Appl. No.: 15/828,686

(22) Filed: Dec. 1, 2017

(30) Foreign Application Priority Data

Sep. 4, 2017 (TW) ..... 106130126 A

(51) Int. Cl.

| | |
|---|---|
| ***H01Q 1/24*** | (2006.01) |
| ***H01Q 13/10*** | (2006.01) |
| ***H01Q 5/328*** | (2015.01) |
| ***H01Q 5/321*** | (2015.01) |
| ***H01Q 1/44*** | (2006.01) |
| ***H01Q 5/335*** | (2015.01) |
| ***H01Q 21/30*** | (2006.01) |
| ***H01Q 9/04*** | (2006.01) |

(52) U.S. Cl.
CPC ..... *H01Q 1/243* (2013.01); *H01Q 1/44* (2013.01); *H01Q 5/321* (2015.01); *H01Q 5/328* (2015.01); *H01Q 5/335* (2015.01); *H01Q 9/0442* (2013.01); *H01Q 13/103* (2013.01); *H01Q 21/30* (2013.01)

(58) Field of Classification Search
CPC ..... H01Q 5/30–5/35; H01Q 21/30; H01Q 1/24–1/243; H01Q 1/44
See application file for complete search history.

(56) References Cited

U.S. PATENT DOCUMENTS

| | | | | |
|---|---|---|---|---|
| 8,907,853 | B2 * | 12/2014 | Ying | H01Q 1/243 343/702 |
| 2015/0123871 | A1 * | 5/2015 | Chang | H01Q 1/243 343/872 |
| 2017/0346159 | A1 * | 11/2017 | Xue | H01Q 5/314 |

* cited by examiner

*Primary Examiner* — Dameon E Levi
*Assistant Examiner* — Hasan Z Islam
(74) *Attorney, Agent, or Firm* — McClure, Qualey & Rodack, LLP

(57) ABSTRACT

A mobile device includes a ground element, a first radiation element, a second radiation element, a third radiation element, a matching circuit, and a first metal frame. The first radiation element and the second radiation element are both coupled to a grounding point on the ground element. The second radiation element and the first radiation element extend in opposite directions. The third radiation element is coupled through the matching circuit to the first radiation element. The first metal frame is coupled to a connection point on the third radiation element. An antenna structure is formed by the first radiation element, the second radiation element, the matching circuit, the third radiation element, and the first metal frame. A signal source is coupled to a feeding point on the first radiation element, so as to excite the antenna structure.

10 Claims, 6 Drawing Sheets

MOBILE DEVICE

CROSS REFERENCE TO RELATED APPLICATIONS

This Application claims priority of Taiwan Patent Application No. 106130126 filed on Sep. 4, 2017, the entirety of which is incorporated by reference herein.

BACKGROUND OF THE INVENTION

Field of the Invention

The disclosure generally relates to a mobile device, and specifically, to a mobile device and an antenna structure therein.

Description of the Related Art

With the progress being made in mobile communication technology, mobile devices such as portable computers, mobile phones, tablet computers, multimedia players, and other hybrid functional mobile devices have become common. To satisfy the demands from users, mobile devices can usually perform wireless communication functions. Some functions cover a large wireless communication area; for example, mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some functions cover a small wireless communication area; for example, mobile phones using Wi-Fi and Bluetooth systems and using frequency bands of 2.4 GHz, 5.2 GHz, and 5.8 GHz.

In order to improve the device's appearance, designers often incorporate metal elements into mobile devices. However, these added metal elements tend to negatively affect the antennas used for wireless communication in mobile devices, thereby degrading the overall communication quality of mobile devices. As a result, there is a need to propose a novel mobile device with a novel antenna structure, so as to overcome the problems of the prior art.

BRIEF SUMMARY OF THE INVENTION

In a preferred embodiment, the disclosure is directed to a mobile device that includes a ground element, a first radiation element, a second radiation element, a third radiation element, a matching circuit, and a first metal frame. The first radiation element and the second radiation element are both coupled to a grounding point on the ground element. The second radiation element and the first radiation element extend in opposite directions. The third radiation element is coupled through the matching circuit to the first radiation element. The first metal frame is coupled to a connection point on the third radiation element. An antenna structure is formed by the first radiation element, the second radiation element, the matching circuit, the third radiation element, and the first metal frame. A signal source is coupled to a feeding point on the first radiation element, so as to excite the antenna structure.

In some embodiments, the mobile device further includes a dielectric substrate. The ground element, the first radiation element, the second radiation element, the third radiation element, and the matching circuit are disposed on the dielectric substrate.

In some embodiments, the first metal frame is disposed on a plane which is perpendicular to the dielectric substrate.

In some embodiments, the first metal frame substantially has a straight-line shape.

In some embodiments, the mobile device further includes a second metal frame.

The second metal frame is coupled to the ground element, and substantially has a U-shape. The second metal frame is separated from the first metal frame by a first gap and a second gap.

In some embodiments, the matching circuit includes a capacitor and an inductor coupled in parallel.

In some embodiments, the antenna structure covers a low-frequency band from 791 MHz to 960 MHz, a first high-frequency band is at 1575 MHz, a second high-frequency band from 1710 MHz to 2170 MHz, and a third high-frequency band from 2500 MHz to 2700 MHz.

In some embodiments, a first resonant path is formed by the first metal frame, the third radiation element, the matching circuit, and the first radiation element. A second resonant path is formed by the second radiation element.

In some embodiments, the total length of the first resonant path is substantially equal to or shorter than 0.25 wavelength of the central frequency of the low-frequency band.

In some embodiments, the total length of the second resonant path is substantially equal to 0.25 wavelength of the central frequency of the second high-frequency band.

BRIEF DESCRIPTION OF DRAWINGS

The invention can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are described in detail below.

Certain terms are used throughout the description and following claims to refer to particular components. As one skilled in the art will appreciate, manufacturers may refer to a component by different names. This document does not intend to distinguish between components that differ in name but not function. In the following description and in the claims, the terms "include" and "comprise" are used in an open-ended fashion, and thus should be interpreted to mean "include, but not limited to . . . ". The term "substantially" means the value is within an acceptable error range. One skilled in the art can solve the technical problem within a predetermined error range and achieve the proposed technical performance. Also, the term "couple" is intended to mean either an indirect or direct electrical connection. Accordingly, if one device is coupled to another device, that connection may be through a direct electrical connection, or through an indirect electrical connection via other devices and connections.

Figure 1A:
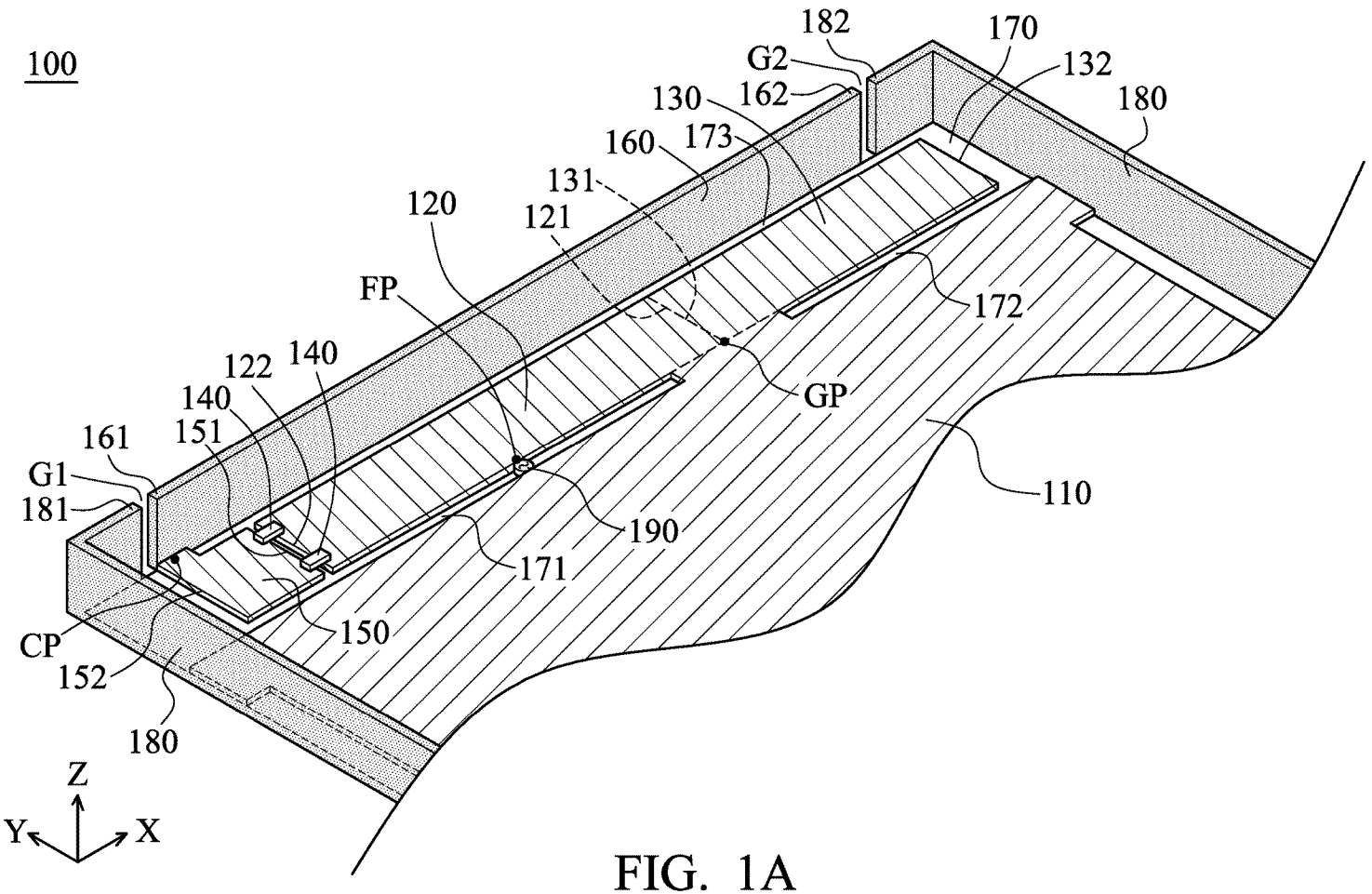
FIG. 1A is a perspective view of a mobile device according to an embodiment of the invention.
Figure 1B:
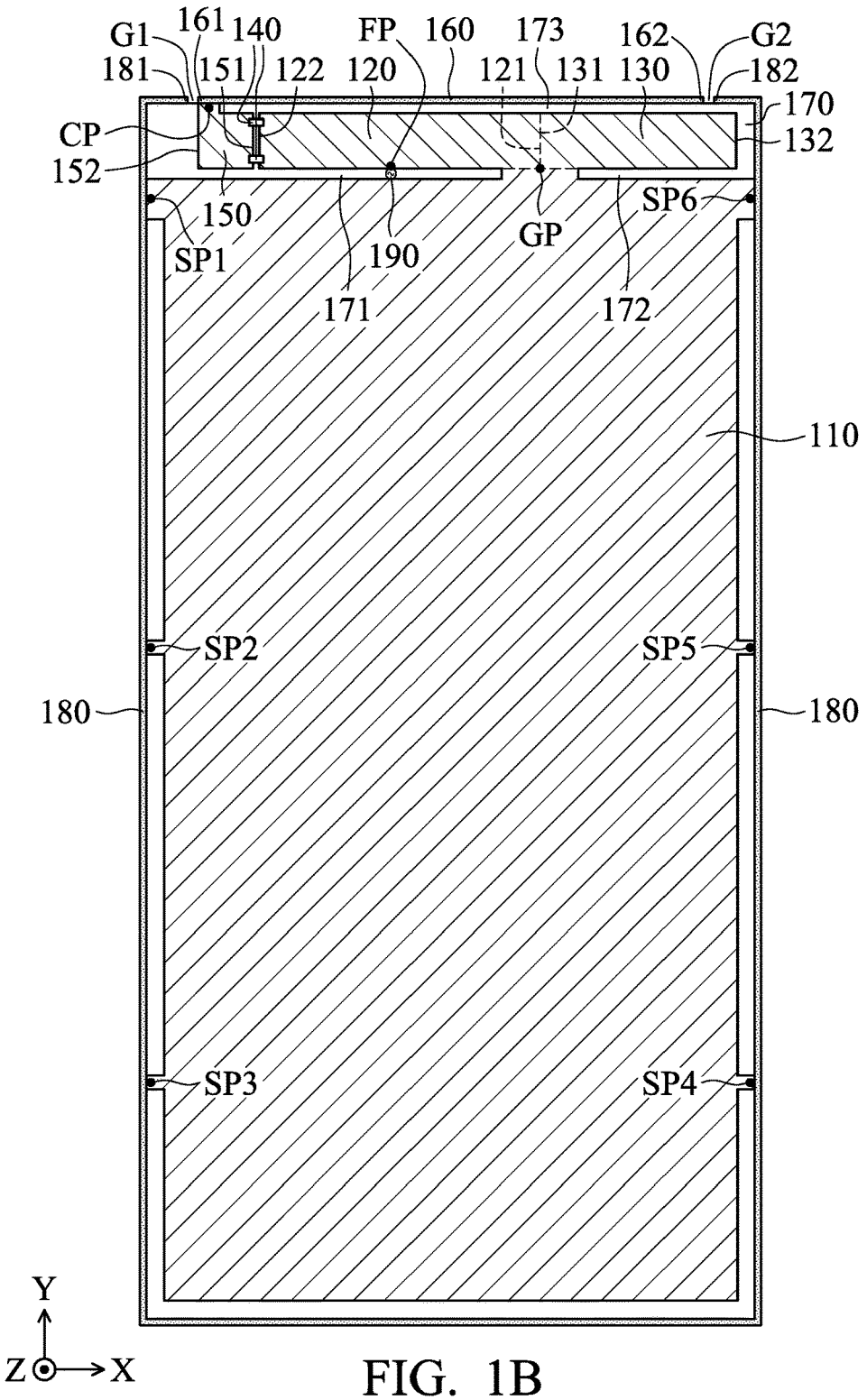
FIG. 1B is a top view of a mobile device according to an embodiment of the invention.

FIG. 1A is a perspective view of a mobile device 100 according to an embodiment of the invention. FIG. 1B is a top view of the mobile device 100 according to an embodiment of the invention. Please refer to FIG. 1A and FIG. 1B together. The mobile device 100 may be a smartphone, a tablet computer, or a notebook computer. In the embodiment of FIG. 1A and FIG. 1B, the mobile device 100 at least includes a ground element 110, a first radiation element 120, a second radiation element 130, a matching circuit 140, a third radiation element 150, and a first metal frame 160. It should be noted that the mobile device 100 may include other components, such as a processor, a touch control panel, a speaker, a battery module, and a housing, although they are not displayed in FIG. 1A and FIG. 1B.

The ground element 110, the first radiation element 120, the second radiation element 130, and the third radiation element 150 may be made of metal materials, such as copper, silver, aluminum, iron, or their alloys. In some embodiments, the mobile device 100 further includes a dielectric substrate 170, such as a PCB (Printed Circuit Board) or an FR4 (Flame Retardant 4) substrate. The ground element 110, the first radiation element 120, the second radiation element 130, the third radiation element 150, and the matching circuit 140 are all disposed on the dielectric substrate 170. In a preferred embodiment, an antenna structure is formed by the first radiation element 120, the second radiation element 130, the matching circuit 140, the third radiation element 150, and the first metal frame 160.

The first radiation element 120 may substantially have a straight-line shape. The first radiation element 120 has a first end 121 and a second end 122. The first end 121 of the first radiation element 120 is coupled to a grounding point GP on the ground element 110. The second radiation element 130 may also substantially have a straight-line shape. The length of the second radiation element 130 is shorter than the length of the first radiation element 120. The second radiation element 130 has a first end 131 and a second end 132. The first end 131 of the second radiation element 130 is coupled to the grounding point GP and the first end 121 of the first radiation element 120. The second end 132 of the second radiation element 130 and the second end 122 of the first radiation element 120 extend in opposite directions. For example, the second end 132 of the second radiation element 130 may extend in the direction parallel to the +X axis, and the second end 122 of the first radiation element 120 extend may extend in the direction parallel to the −X axis. The matching circuit 140 may include one or more capacitors and/or one or more inductors, such as chip capacitors and/or chip inductors. The third radiation element 150 may substantially have a rectangular shape. The length of the third radiation element 150 is shorter than the length of the second radiation element 130. The third radiation element 150 has a first end 151 and a second end 152. The first end 151 of the third radiation element 150 is coupled through the matching circuit 140 to the second end 122 of the first radiation element 120. The first metal frame 160 is coupled to a connection point CP on the third radiation element 150. The connection point CP is adjacent to the second end 152 of the third radiation element 150. A signal source 190 is coupled to a feeding point FP on the first radiation element 120, so as to excite the aforementioned antenna structure. The feeding point FP is positioned between the grounding point GP and the second end 122 of the first radiation element 120. For example, the grounding point FP may be substantially positioned at the central point between the grounding point GP and the second end 122 of the first radiation element 120.

In some embodiments, a first slot region 171, a second slot region 172, and a third slot region 173 are formed on the dielectric substrate 170. Each slot region has a narrow and long straight-line shape, inside which no metal component is disposed. The first slot region 171 is configured to at least partially separate the first radiation element 120 from the ground element 110, and completely separate the third radiation element 150 from the ground element 110. The second slot region 172 is configured to at least partially separate the second radiation element 130 from the ground element 110. Furthermore, the third slot region 173 is configured to completely separate the first radiation element 120 and the second radiation element 130 from the first metal frame 160, and at least partially separate the third radiation element 150 from the first metal frame 160, such that the first metal frame 160 is only coupled to the connection point CP on the third radiation element 150.

The first metal frame 160 may substantially have a straight-line shape. The first metal frame 160 is disposed on a plane which is perpendicular to the dielectric substrate 170. For example, if the dielectric substrate 170 is parallel to the XY-plane, the first metal frame 160 may be parallel to the XZ-plane. In some embodiments, the mobile device 100 further includes a second metal frame 180. The second metal frame 180 may substantially have a U-shape. The length of the second metal frame 180 is much longer than the length of the first metal frame 160. For example, the length of the second metal frame 180 is from 3 to 5 times the length of the first metal frame 160. The second metal frame 180 is coupled to six shorting points SP1, SP2, SP3, SP4, SP5, and SP6 on the ground element 110, so as to suppress undesired resonant modes. The positions and the number of these shorting points can be adjusted to meet different requirements. The second metal frame 180 is completely separated from the first metal frame 160 by a first gap G1 and a second gap G2. Specifically, the first metal frame 160 has a first end 161 and a second end 162, and the second metal frame 180 has a first end 181 and a second end 182. The first gap G1 is positioned between the first end 161 of the first metal frame 160 and the first end 181 of the second metal frame 180. The second gap G2 is positioned between the second end 162 of the first metal frame 160 and the second end 182 of the second metal frame 180. Both the first metal frame 160 and the second metal frame 180 are appearance elements of the mobile device 100. However, the first metal frame 160 is considered as an extension portion of the aforementioned antenna structure because the first metal frame 160 is independent of the second metal frame 180 and is coupled to the third radiation element 150. On the contrary, the second metal frame 180 is an optional element, which is removable in other embodiments.

Figure 2:
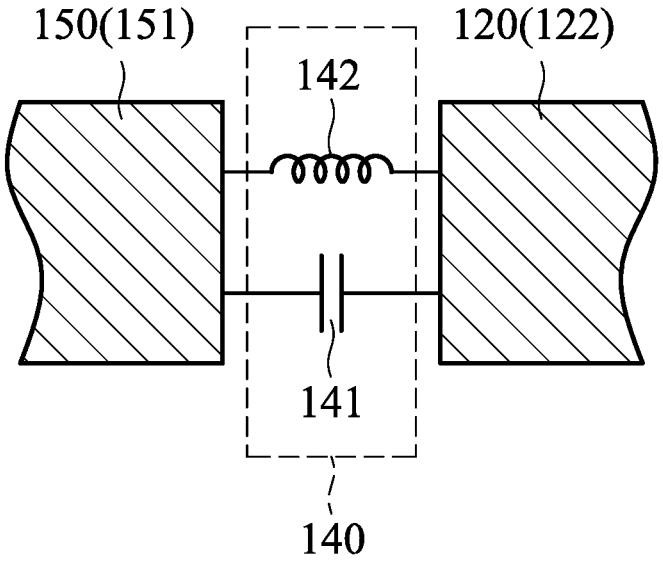
FIG. 2 is a diagram of a matching circuit according to an embodiment of the invention.

FIG. 2 is a diagram of the matching circuit 140 according to an embodiment of the invention. In the embodiment of FIG. 2, the matching circuit 140 includes a capacitor 141 and an inductor 142. The capacitor 141 and the inductor 142 are coupled in parallel between the first end 151 of the third radiation element 150 and the second end 122 of the first radiation element 120. However, the invention is not limited to the above. In other embodiments, the inner components of the matching circuit 140 can be adjusted to meet different requirements. For example, adjustments can be made so that the matching circuit 140 includes only either the capacitor 141 or the inductor 142.

Figure 3:
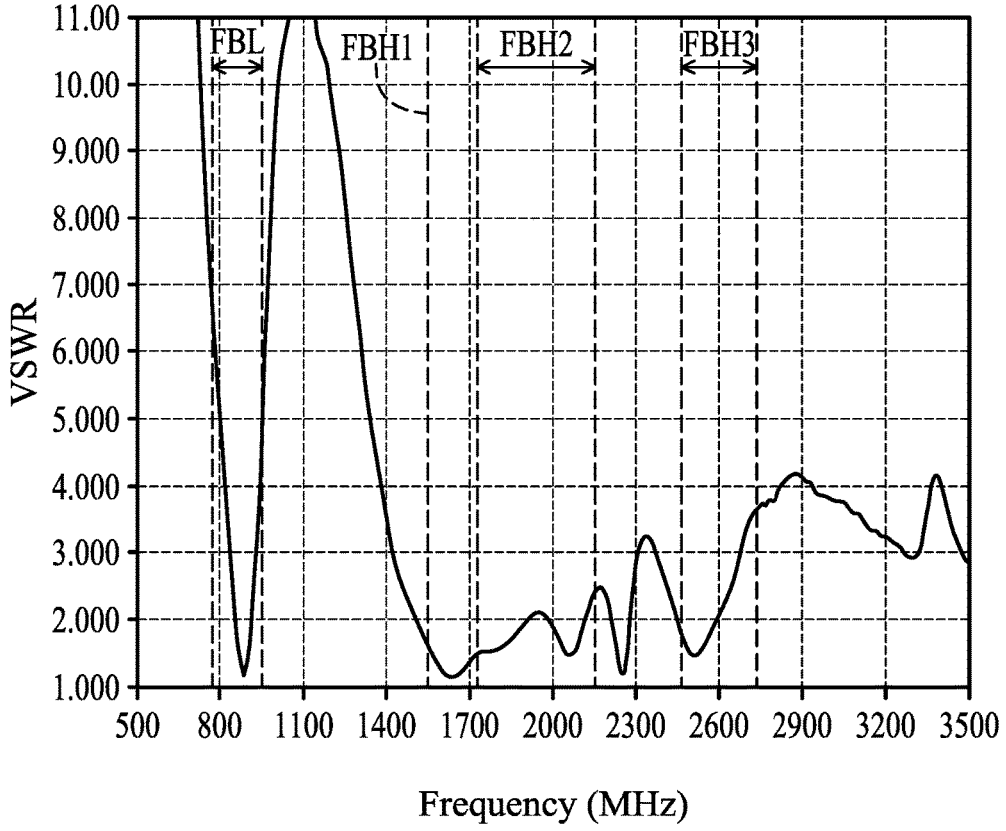
FIG. 3 is a diagram of VSWR (Voltage Standing Wave Ratio) of an antenna structure of a mobile device according to an embodiment of the invention.

FIG. 3 is a diagram of VSWR (Voltage Standing Wave Ratio) of the antenna structure of the mobile device 100 according to an embodiment of the invention. The horizontal axis represents operation frequency (MHz), and the vertical axis represents the VSWR. According to the measurement of FIG. 3, when receiving or transmitting wireless signals, the antenna structure of the mobile device 100 can cover a low-frequency band FBL, a first high-frequency band FBH1, a second high-frequency band FBH2, and a third high-frequency band FBH3. The low-frequency band FBL may be from about 791 MHz to about 960 MHz. The first high-frequency band FBH1 is at around 1575 MHz. The second high-frequency band FBH2 may be from about 1710 MHz to about 2170 MHz. The third high-frequency band FBH3 may be from about 2500 MHz to about 2700 MHz. Therefore, the antenna structure of the mobile device 100 can support at least the wideband operation of GPS (Global Positioning System) and LTE (Long Term Evolution) Band 1/2/3/4/5/6/7/8/9/10/11/18/19/20/21/23/24/25/26/27/30/32/33/34/35/36/37/38/39/40/41.

Figure 4:
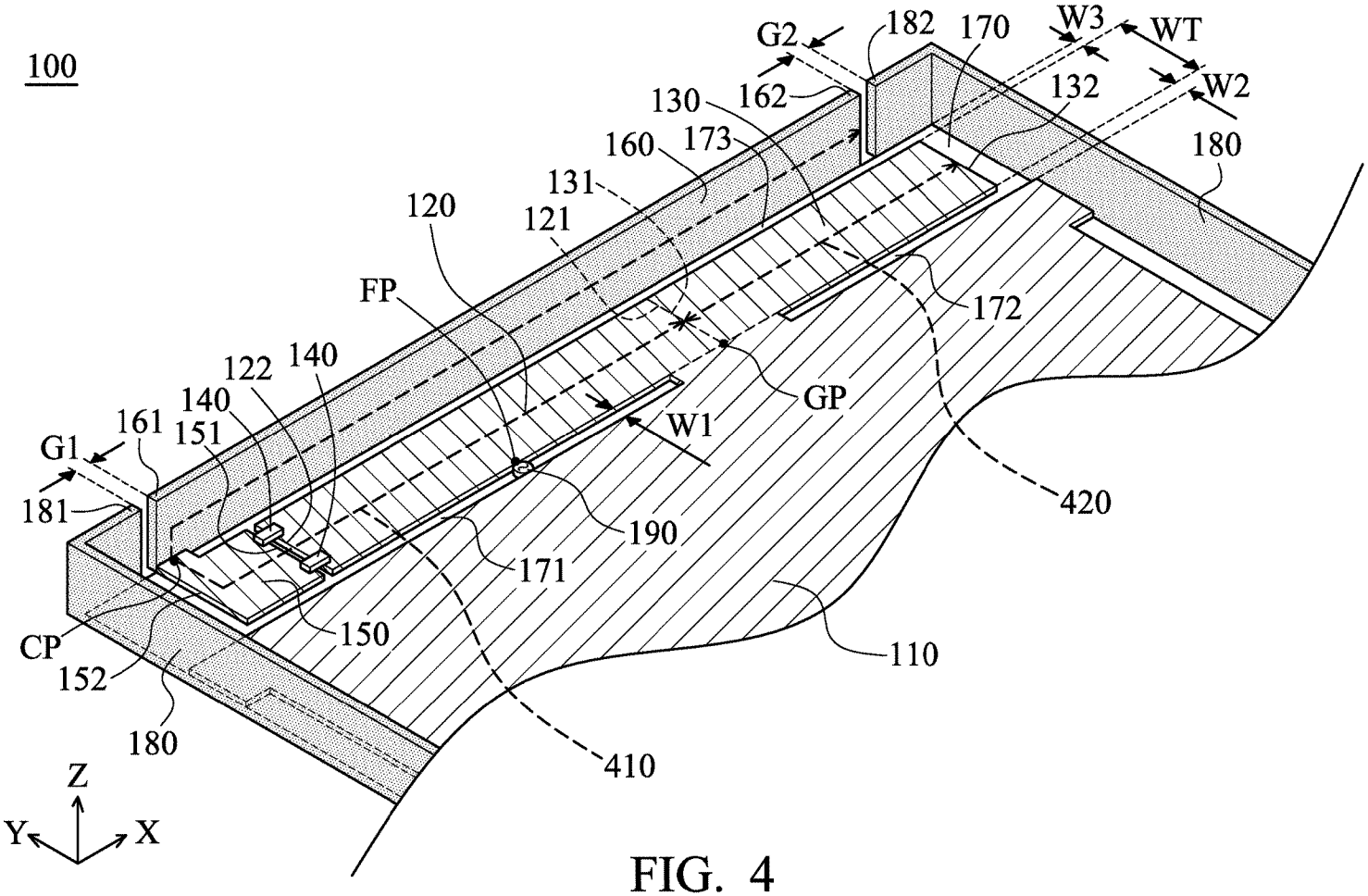
FIG. 4 is a diagram of element sizes of a mobile device according to an embodiment of the invention.

FIG. 4 is a diagram of element sizes of the mobile device 100 according to an embodiment of the invention. The operation theory of the antenna structure of the mobile device 100 is as follows. A first resonant path 410 is formed by the first metal frame 160, the third radiation element 150, the matching circuit 140, and the first radiation element 120. The first resonant path 410 is substantially from the grounding point GP to the second end 162 of the first metal frame 160. A second resonant path 420 is formed by the second radiation element 130. The second resonant path 420 is substantially from the grounding point GP to the second end 132 of the second radiation element 130. The first resonant path 410 can be excited to generate the aforementioned low-frequency band FBL and the aforementioned second high-frequency band FBH2. The second resonant path 420 can be excited to generate the aforementioned third high-frequency band FBH3. In addition, the first radiation element 120, the third radiation element 150, the ground element 110, and the first slot region 171 therebetween can be excited to generate the aforementioned first high-frequency band FBH1.

In some embodiments, the element sizes of the mobile device 100 are as follows. The total length of the first resonant path 410 is substantially equal to or shorter than 0.25 wavelength (λ/4) of the central frequency of the low-frequency band FBL. The total length of the second resonant path 420 is substantially equal to 0.25 wavelength (λ/4) of the central frequency of the second high-frequency band FBH2. The width of the first gap G1 is from 0 mm to 2 mm, such as 1 mm. The width of the second gap G2 is from 0 mm to 2 mm, such as 1 mm. The width W1 of the first slot region 171 is from 0 mm to 2 mm, such as 1 mm. The width W2 of the second slot region 172 is from 0 mm to 2 mm, such as 1 mm. The width W3 of the third slot region 173 is from 0 mm to 2 mm, such as 1 mm. The width WT of each of the first radiation element 120, the second radiation element 130, and the third radiation element 150 is at least 5 mm. The above element sizes are calculated and obtained according to many experimental results, and they help to optimize the operation frequency band and the impedance matching of the antenna structure of the mobile device 100. It should be noted that because the aforementioned width WT is sufficiently large, in some embodiments, one or more of the first radiation element 120, the second radiation element 130, and the third radiation element 150 can be used to carry and support a plurality of electronic components, such as a camera module or a USB (Universal Serial Bus) socket. Such a design can integrate the antenna structure with the electronic components, thereby more effectively using the inner space of the mobile device 100. According to practical measurements, these electronic components do not interfere with the radiation performance of the antenna structure.

Figure 5:
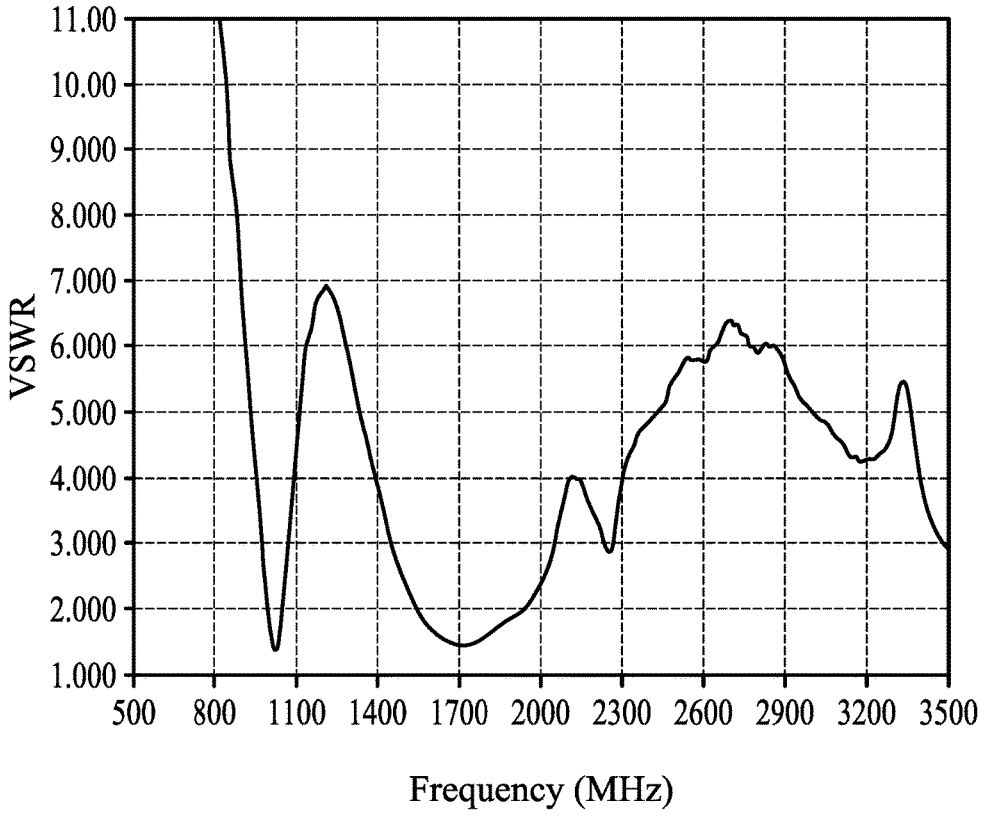
FIG. 5 is a diagram of VSWR of an antenna structure of a mobile device when the matching circuit is removed.

FIG. 5 is a diagram of VSWR of the antenna structure of the mobile device 100 when the matching circuit 140 is removed. By comparing FIG. 5 with FIG. 3, it can be seen that the matching circuit 140 is arranged for fine-tuning the impedance matching of the antenna structure. Specifically, the capacitor 141 of the matching circuit 140 is configured to fine-tune the impedance matching of the second high-frequency band FBH2 and the third high-frequency band FBH3, and the inductor 142 of the matching circuit 140 is configured to fine-tune the impedance matching of the low-frequency band FBL. If the matching circuit 140 is not in use, the low-frequency band FBL of the antenna structure may move toward the higher frequency, and the bandwidths of the second high-frequency band FBH2 and the third high-frequency band FBH3 may become insufficient. The incorporation of the matching circuit 140 can help to reduce the total length of the first resonant path 410.

The invention proposes a novel antenna structure. When the antenna structure is applied to a mobile device including a metal frame, the metal frame is considered as an extension portion of the antenna structure, and therefore such a design can prevent the metal frame from negatively affecting the communication quality of the mobile device. Furthermore, the metal frame is used as an effective radiation element for reducing the total antenna size and increasing the antenna operation bandwidth. It should also be noted that the invention can improve the appearance of the mobile device without opening any antenna windows. In conclusion, the invention has the advantages of small device size, wide bandwidth, and beautiful device appearance, and it is suitable for application in a variety of mobile communication devices.

Note that the above element sizes, element shapes, and frequency ranges are not limitations of the invention. An antenna designer can adjust these settings or values in order to meet different requirements. It should be understood that the mobile device and the antenna structure of the invention are not limited to the configurations illustrated in FIGS. 1-4. The invention may merely include any one or more features of any one or more embodiments of FIGS. 1-4. In other words, not all of the features shown in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for use of the ordinal term) to distinguish the claim elements.

It will be apparent to those skilled in the art that various modifications and variations can be made in the invention. It is intended that the standard and examples be considered as exemplary only, with the true scope of the disclosed embodiments being indicated by the following claims and their equivalents.

What is claimed is:

1. A mobile device, comprising:

a ground element;

a first radiation element, coupled to a grounding point on the ground element;

a second radiation element, coupled to the grounding point, wherein the second radiation element and the first radiation element extend in opposite directions;

a matching circuit;

a third radiation element, coupled through the matching circuit to the first radiation element; and a first metal frame, coupled to a connection point on the third radiation element;

wherein an antenna structure is formed by the first radiation element, the second radiation element, the matching circuit, the third radiation element, and the first metal frame;

wherein a signal source is coupled to a feeding point on the first radiation element, so as to excite the antenna structure.

2. The mobile device as claimed in claim 1, further comprising:

a dielectric substrate, wherein the ground element, the first radiation element, the second radiation element, the third radiation element, and the matching circuit are disposed on the dielectric substrate.

3. The mobile device as claimed in claim 2, wherein the first metal frame is disposed on a plane which is perpendicular to the dielectric substrate.

4. The mobile device as claimed in claim 1, wherein the first metal frame substantially has a straight-line shape.

5. The mobile device as claimed in claim 1, further comprising:

a second metal frame, coupled to the ground element, and substantially having a U-shape, wherein the second metal frame is separated from the first metal frame by a first gap and a second gap.

6. The mobile device as claimed in claim 1, wherein the matching circuit comprises a capacitor and an inductor coupled in parallel.

7. The mobile device as claimed in claim 1, wherein the antenna structure covers a low-frequency band from 791 MHz to 960 MHz, a first high-frequency band is at 1575 MHz, a second high-frequency band from 1710 MHz to 2170 MHz, and a third high-frequency band from 2500 MHz to 2700 MHz.

8. The mobile device as claimed in claim 7, wherein a first resonant path is formed by the first metal frame, the third radiation element, the matching circuit, and the first radiation element, and wherein a second resonant path is formed by the second radiation element.

9. The mobile device as claimed in claim 8, wherein a total length of the first resonant path is substantially equal to or shorter than 0.25 wavelength of a central frequency of the low-frequency band.

10. The mobile device as claimed in claim 8, wherein a total length of the second resonant path is substantially equal to 0.25 wavelength of a central frequency of the second high-frequency band.

* * * * *